US012622516B1

(12) United States Patent
Chen

(10) Patent No.: US 12,622,516 B1
(45) Date of Patent: May 12, 2026

(54) CONCAVE SQUARE TUBE STORAGE SHELF

(71) Applicant: Protrend Co., Ltd., Taipei City (TW)

(72) Inventor: Shun-Yi Chen, Taipei City (TW)

(73) Assignee: PROTREND CO., LTD., Taipei City (TW)

( * ) Notice: Subject to any disclaimer, the term of this patent is extended or adjusted under 35 U.S.C. 154(b) by 0 days.

(21) Appl. No.: 19/023,518

(22) Filed: Jan. 16, 2025

(30) Foreign Application Priority Data

Dec. 30, 2024 (TW) ..... 113151573

(51) Int. Cl.
*A47B 57/40* (2006.01)
*A47B 57/34* (2006.01)

(52) U.S. Cl.
CPC ..... *A47B 57/40* (2013.01); *A47B 57/34* (2013.01)

(58) Field of Classification Search
CPC ... A47B 57/482; A47B 57/265; A47B 57/545; A47B 57/20; A47B 57/40; A47B 57/34; A47B 57/12; A47B 57/14; A47B 57/36; A47B 57/38; A47B 96/1433
See application file for complete search history.

(56) References Cited

U.S. PATENT DOCUMENTS 1,872,429 A * 8/1932 Eaglesfield ..... A47B 57/34 248/243
3,082,711 A * 3/1963 Vetere ..... F16B 12/50 248/245
3,199,471 A * 8/1965 Orsi ..... F16B 12/50 211/187
3,472,476 A * 10/1969 Johnson ..... A47B 57/562 248/245
3,847,489 A * 11/1974 Van Riper ..... F16B 7/0446 248/245
RE28,293 E * 1/1975 Bustos ..... A47B 87/0269 108/151
3,972,638 A * 8/1976 Vivoli ..... E04B 2/76 403/174
4,142,638 A * 3/1979 Vargo ..... A47B 57/34 211/187

(Continued)

FOREIGN PATENT DOCUMENTS

CH 358563 A * 11/1961
CH 454385 A * 4/1968

(Continued)

*Primary Examiner* — Stanton L Krycinski
(74) *Attorney, Agent, or Firm* — WPAT, PC

(57) ABSTRACT

A concave square tube storage shelf is provided. The concave square tube storage shelf includes a plurality of post components, several storage layers, and multiple laminates. These post components includes a concave square tube and multiple convex-type fastened components. These convex-type fastened components are arranged at intervals on the concave tube, with each comprising a fastener body, a convex block, and two assembly notches. The convex block is connected to the fastener body, with assembly notches on both sides of the convex block. The storage layers include a shelf and multiple fasteners. These fasteners are attached to the shelf, and the fasteners engage with corresponding assembly notches to secure the storage layers between the post components. The shelves are placed above the corresponding storage layers.

8 Claims, 13 Drawing Sheets

(56) References Cited

U.S. PATENT DOCUMENTS 4,593,826 A * 6/1986 Bustos ..... A47B 57/265 211/208
4,708,252 A * 11/1987 Azzi ..... A47B 57/402 52/646
4,712,286 A * 12/1987 Wolf ..... A47B 57/40 52/584.1
4,754,712 A * 7/1988 Olson ..... A47B 57/265 108/107
4,815,394 A * 3/1989 Ettlinger ..... A47B 57/265 108/107
4,852,501 A * 8/1989 Olson ..... A47B 57/265 108/107
4,934,858 A * 6/1990 Beaulieu ..... F16B 12/40 403/174
5,048,995 A * 9/1991 Beaulieu ..... F16B 7/0473 403/174
5,174,200 A * 12/1992 Jeandel ..... A47B 57/36 108/193
5,279,231 A * 1/1994 Kolvites ..... A47B 57/265 108/107
5,842,586 A * 12/1998 Melby ..... A47B 57/545 5/10.1
5,971,175 A * 10/1999 Bustos ..... A47F 5/13 211/187
6,167,579 B1 * 1/2001 Kopish ..... A47C 17/62 5/2.1
6,302,284 B1 * 10/2001 Zonshin ..... A47B 47/0083 108/147.11
6,364,138 B1 * 4/2002 Chen ..... A47B 57/26 211/187
6,682,253 B2 * 1/2004 Binna ..... F16L 3/243 52/653.2
7,191,908 B2 * 3/2007 De Rijk ..... A47B 57/48 211/208
8,016,140 B2 * 9/2011 Hsieh ..... A47B 47/0083 211/187
8,118,181 B2 * 2/2012 Shinozaki ..... A47B 47/0083 211/208
8,286,564 B2 * 10/2012 Karl ..... A47B 57/545 108/107
8,302,788 B2 * 11/2012 Vargo ..... A47B 57/50 211/186
8,376,156 B2 * 2/2013 Jarvis ..... A47B 47/045 211/187
8,376,157 B2 * 2/2013 Jarvis ..... A47B 57/545 211/187
8,627,966 B2 * 1/2014 Jarvis ..... A47B 57/545 211/187
8,651,300 B2 * 2/2014 Chen ..... A47B 47/024 211/187
10,206,506 B1 * 2/2019 Lai ..... A47B 96/1433
10,441,074 B2 * 10/2019 Dahatonde ..... A47B 96/1441
10,455,935 B1 * 10/2019 Chen ..... A47B 47/027
10,960,910 B1 * 3/2021 Garcia ..... B62B 3/02
11,583,074 B2 * 2/2023 Nilsson ..... A47F 5/103
11,607,037 B2 * 3/2023 Baez ..... A47B 57/545
11,627,801 B2 * 4/2023 Chen ..... A47B 57/48 211/187
11,627,802 B1 * 4/2023 Liu ..... A47B 57/40 211/187
11,700,940 B1 * 7/2023 Chen ..... F16B 2/245 211/187
12,185,834 B1 * 1/2025 Chen ..... A47B 57/402
12,268,302 B2 * 4/2025 Cai ..... A47B 47/03
12,310,492 B2 * 5/2025 Shinozaki ..... A47B 47/0083
12,317,997 B2 * 6/2025 Carlson ..... A47B 57/265
2010/0096352 A1 * 4/2010 Wang ..... A47B 47/045 211/187
2015/0272322 A1 * 10/2015 Wu ..... A47B 47/0008 428/99
2021/0186211 A1 * 6/2021 Baez ..... A47B 57/545

FOREIGN PATENT DOCUMENTS

CH 663340 A5 * 12/1987 ..... E04B 2/80
DE 1198025 B * 8/1965
DE 10218529 C1 * 7/2003 ..... A47B 57/482
EP 0451012 A1 * 10/1991 ..... A47B 57/36
FR 1388765 A * 2/1965 ..... A47B 57/404
FR 2484806 A1 * 12/1981 ..... A47B 57/402
FR 2660176 A1 * 10/1991 ..... A47B 57/36
FR 2905677 A1 * 3/2008 ..... B62B 3/005
KR 101505001 B1 * 3/2015 ..... A47B 96/1425

* cited by examiner

CONCAVE SQUARE TUBE STORAGE SHELF

CROSS REFERENCE TO RELATED APPLICATION

This application claims the benefits of Taiwan application Serial No. 113151573, filed on Dec. 30, 2024, the disclosures of which are incorporated by references herein in its entirety.

TECHNICAL FIELD

The present disclosure relates to a storage shelf, and in particular to a concave square tube storage shelf.

BACKGROUND

Assembled shelves are shelves that can be assembled and used for storage, consisting of multiple independent components (such as storage layers and connectors). The design of assembled shelves usually emphasizes flexibility and scalability to meet the needs of home interiors, offices and other occasions.

Traditionally, there is a distinction between circular columns (round tubes) and square columns (square tubes). If circular columns are used, they cannot be horizontally and horizontally assembled for effective expansion. Therefore, the use of square tubes seems to be favorable. However, the structure of the traditional square tube and shelf is relatively complicated and time-consuming to assemble, which in turn leads to disadvantages of production and processing, packaging procedures, and high cost.

SUMMARY

The disclosed embodiment provides a concave square tube storage shelf, the structure is simple and relatively stable, and the convenience of use is improved.

One embodiment of the present disclosure provides a concave square tube storage shelf comprising a plurality of post columns, a plurality of storage layers, and a plurality of laminates. The post columns respectively comprise a concave square tube and a plurality of convex-type fastened components. Each of the concave square tubes comprises a first plate, a second plate, a third plate, and a concave plate, each of the first plates and the corresponding second plate are parallel to each other, both sides of each of the third plates are respectively connected to the corresponding first plate and the corresponding second plate, both sides of each of the concave plates are respectively connected to the corresponding first plate and the corresponding second plate, the convex-type fastened components are respectively assembled on the concave plate at intervals, and each of the convex-type fastened components comprises a fastener body, a convex block, and two assembly notches, each of the convex blocks is connected to the corresponding fastener body, and two sides of each of the convex blocks are provided with the assembly notch. The storage layers respectively comprise a shelf and a plurality of fasteners, wherein the fasteners are provided on the shelf, wherein the fasteners are respectively engaged to the corresponding assembly notch to secure the storage layers between the post columns. The laminates are respectively disposed on the corresponding storage layer.

In one embodiment, each of the concave plates comprises a concave portion, a first plate portion, and a second plate portion, and both sides of each of the concave portions are connected to the corresponding first plate portion and the second plate portion, each of the first plate portions is connected to the corresponding first plate, each of the second plate portions is connected to the corresponding second plate, both sides of each of the fastener bodies are connected to the corresponding first plate portion and the corresponding second plate portion respectively.

In one embodiment, each of the convex-type fastened components is separated from the concave portion in the corresponding concave plate by a distance, and each of the convex-type fastened components is inclined outwardly at an inclination angle relative to the concave square tube.

In one embodiment, two sides of each of the fastener bodies has a first block and a second block respectively, one of the assembly notches is formed between a top of each first block and the corresponding convex block, and another one of the assembly notches is formed between a top of each second block and the corresponding convex block.

In one embodiment, the fasteners have an inclination plane.

In one embodiment, the fasteners are two first fasteners and two second fasteners.

In one embodiment, each of the storage layers comprises two first assembly components and two second assembly components, each of the first assembly components is a Z-shaped buckle structure, the first fasteners are fasteners of the Z-shaped fastener structure, each of the second assembly components is an L-shaped buckle structure, and each of the second fasteners is a fastener of the L-shaped buckle structure.

Based on the foregoing, the concave square tube storage shelf of the present disclosure has a simple assembly structure and is relatively stable, thereby improving the overall using convenience.

Furthermore, the square tube is changed into a concave square tube by the present disclosure to increase the structural strength.

A detailed description is given in the following embodiments with reference to the accompanying drawings, in order to make the disclosure more comprehensible.

BRIEF DESCRIPTION OF THE DRA WINGS

DETAILED DESCRIPTION

The following embodiments are set forth in detail with accompanying drawings, but the embodiments provided are not intended to limit the scope of the disclosure. In addition, the drawings are for illustrative purposes only and are not drawn to original size. To facilitate understanding, the same components will be identified with the same symbols in the following description.

The terms "including", "comprising", "having", etc. mentioned in the disclosure are open terms, which means "including but not limited to".

In the description of various embodiments, when describing the components in terms of "first," "second," "third," "fourth," and the like, it is used only to distinguish these components from one another, and does not limit the order or importance of these components.

In the description of various embodiments, the so-called "component" may refer to a single portion or element that constitutes a larger system, device or structure. The components can be independent or cooperate with other components to complete specific functions. Components have different specific meanings in different fields, but they generally refer to a basic unit that makes up the whole.

In the description of various embodiments, the so-called "square tube" refers to a tube with a square cross-section. In addition, the so-called "concave square tube" refers to a structure in which at least one plate is a concave structure.

In the description of various embodiments, the so-called "hollow tube" refers to a circular or other-shaped tubular structure with a cavity inside and a certain thickness outside. Hollow tubes are different from solid tubes in that they are hollow on the inside, enabling them to reduce weight, save materials and provide greater space efficiency.

In the description of various embodiments, the so-called "recessed part" refers to a part of a certain area or surface that is lower in depth than other surrounding parts and presents a concave or recessed state.

In the description of various embodiments, the so-called "stacking direction" refers to the way or order in which objects are stacked and arranged, and usually refers to the relative position and arrangement direction of objects in space.

In the description of various embodiments, the so-called "assembly direction" refers to the direction in which components, parts or elements are connected or arranged in a certain way or sequence during the assembly process, and describes how to assemble each part at a specific angle, position or sequence.

In the description of various embodiments, the so-called "lifting direction" refers to the movement in the vertical direction, which corresponds to the movement in the horizontal direction, such as the moving direction of an object along the vertical axis, including the upward (rising) or downward (falling) motion of an object.

Figure 1:
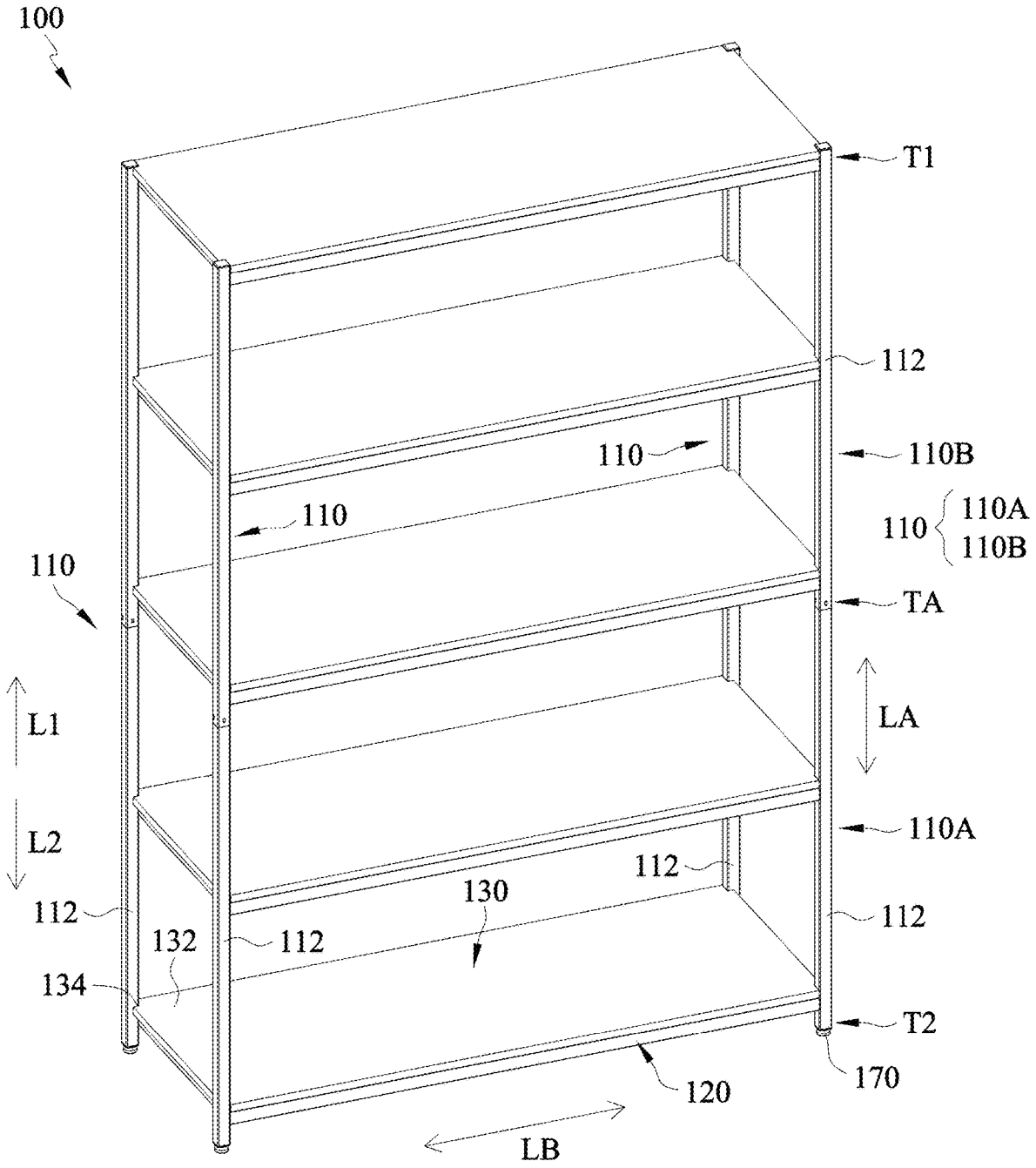
FIG. 1 is a three-dimensional diagram of an embodiment of a concave square tube storage shelf according to the present disclosure.

FIG. 1 is a three-dimensional diagram of an embodiment of a concave square tube storage shelf according to the present disclosure. Please refer to FIG. 1. The concave square tube storage shelf 100 of the present disclosure includes a plurality of post components 110, five storage layers 120, and five laminates 130. The number of storage layers 120 and laminates 130 can be multiple. There are four post columns 110 in total as shown in FIG. 1. The two post columns 110 at the front are separated by a distance, the two post columns 110 at the rear are also separated by a distance, and the two post columns 110 at the front and rear are also separated by a distance. These post columns 110 are arranged in a rectangular shape or any shape. The laminates 130 are arranged on the corresponding storage layers 120, and the five storage layers 120 and their connected laminates 130 are sequentially located between the post columns 110 along the stacking direction L1. In addition, these storage layers 120 have structural configurations for moving along the stacking direction L1, and the position of the storage layer 120 can be adjusted according to the size of the objects to enhance the convenience of use and form a variety of different combinations of the concave square tube storage shelf 100.

Figure 2B:
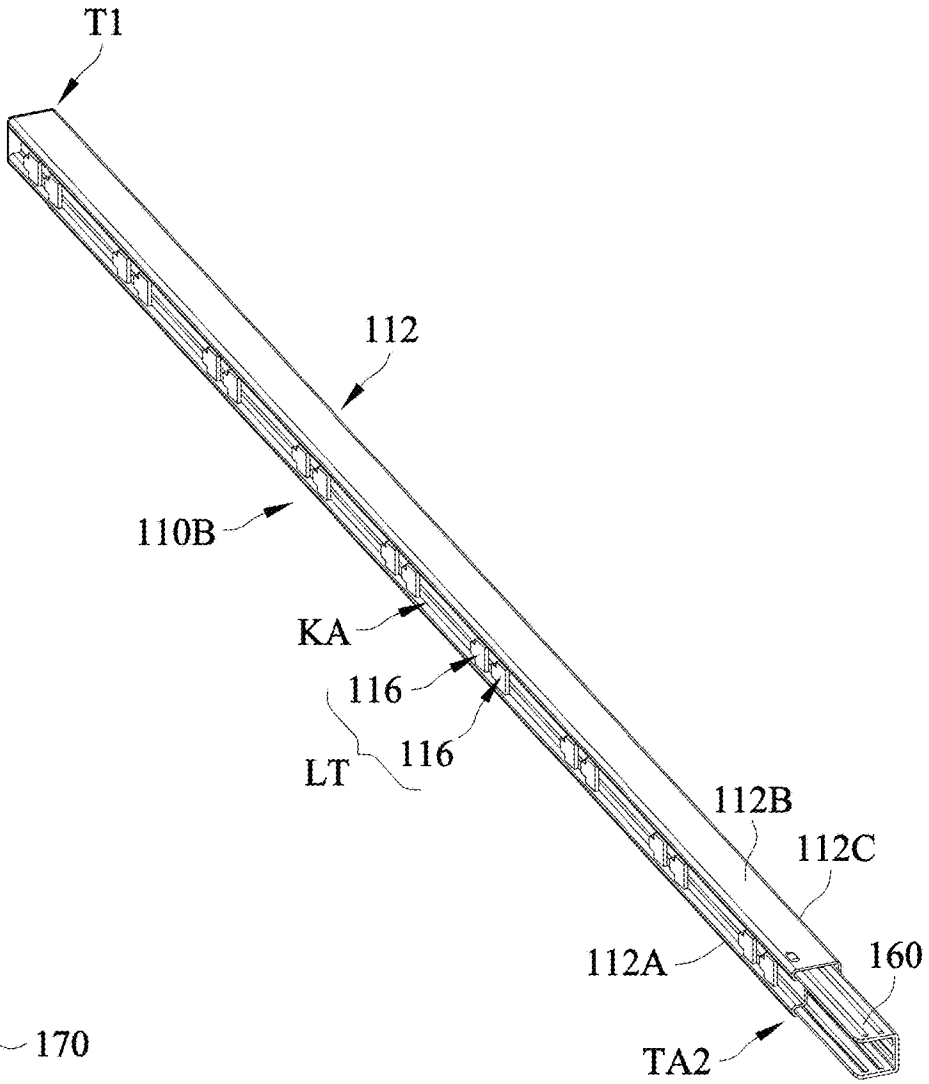
FIG. 2B is a three-dimensional diagram of the second type of post component according to the present disclosure.
Figure 2A:
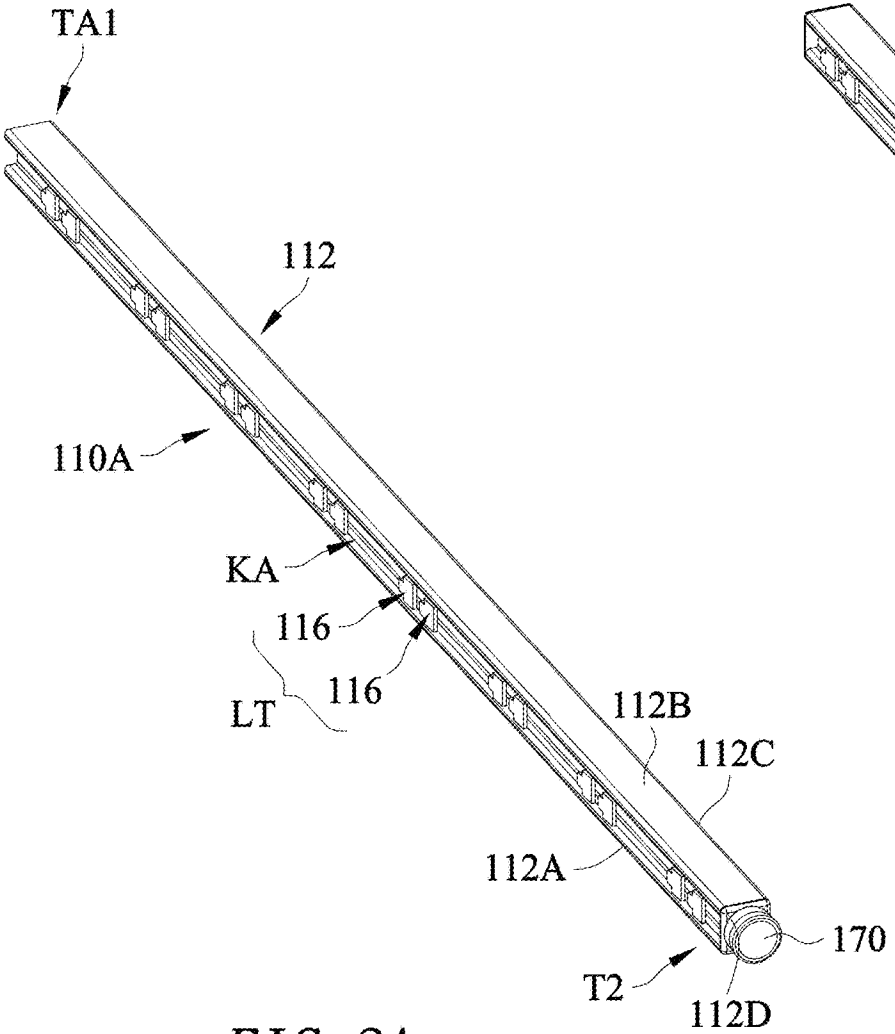
FIG. 2A is a three-dimensional diagram of the first type of post component according to the present disclosure.
Figure 3:
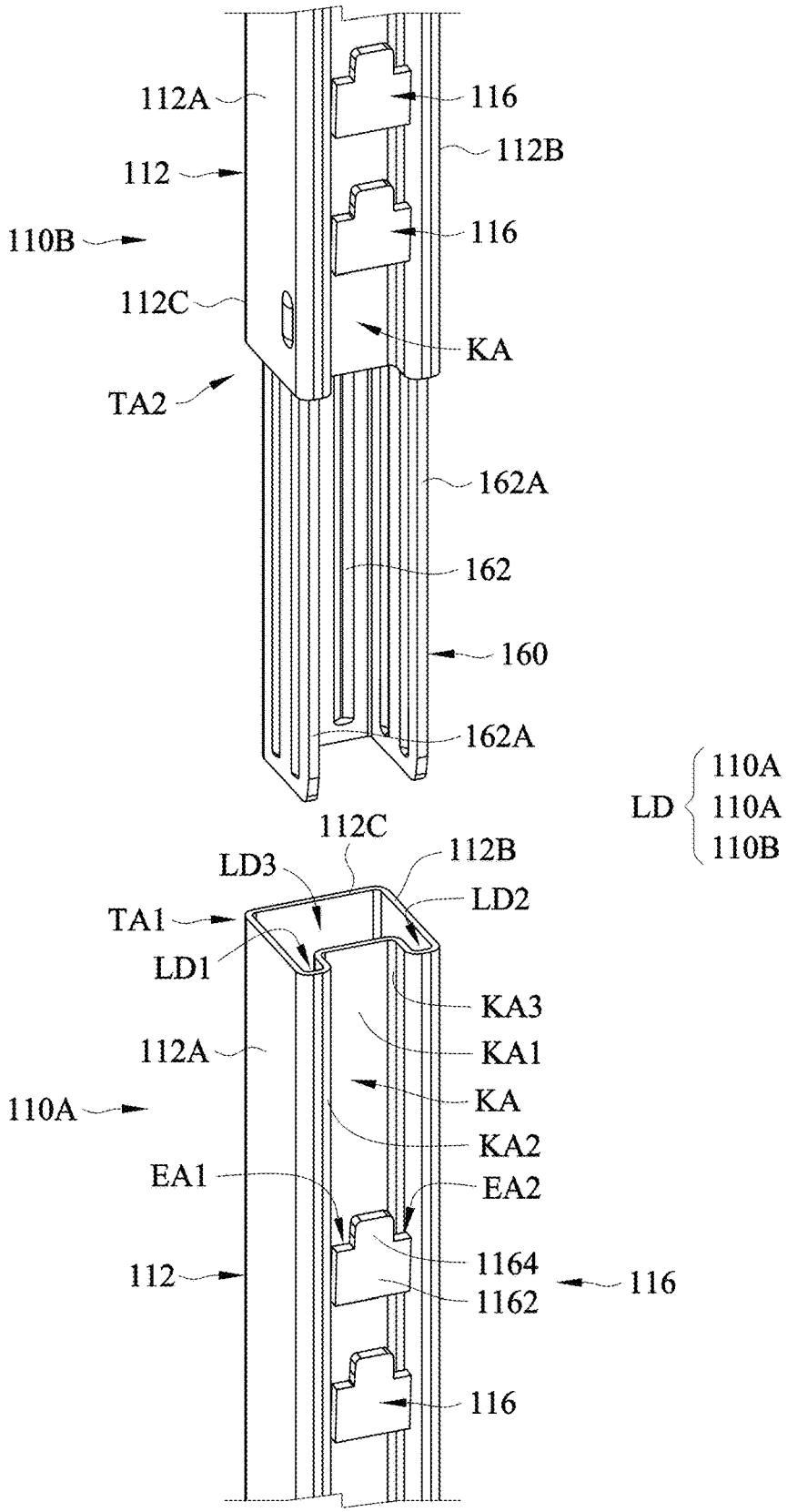
FIG. 3 is a three-dimensional diagram of the assembly process of the first type of post component and the second type of post component according to the present disclosure.

FIG. 2A is a three-dimensional diagram of the first type of post component according to the present disclosure. FIG. 2B is a three-dimensional diagram of the second type of post component according to the present disclosure. FIG. 3 is a three-dimensional diagram of the assembly process of the first type of post component and the second type of post component according to the present disclosure. Please refer to FIGS. 1 to 3. As shown in FIG. 1, the post column 110 has a predetermined length, and the length of the post column 110 can be adjusted according to the actual required height of the concave square tube storage shelf 100. Furthermore, the post column 110 can also be assembled to achieve a predetermined length.

Taking FIG. 1 as an example, the post column 110 has an upper end T1, a lower end T2 opposite to the upper end T1, and an assembly end TA. The assembly end TA is the position where the first type of post column 110A and the second type of post column 110B are assembled together. The first type of post column 110A has a lower end T2, and the lower end T2 is a position of the first type of post column 110A away from the assembly end TA. The second type of post column 110B has an upper end T1, and the upper end T1 is a position of the second type of post column 110B away from the assembly end TA.

Taking FIG. 2A as an example, the first type of post column 110A has an assembly end TA1, and the lower end T2 and the assembly end TA1 are two opposite ends. Taking FIG. 2B as an example, the second type of post column 110B has an assembly end TA2, the connector 160 is adjacent to the assembly end TA2, and the upper end T1 and the assembly end TA2 are two opposite ends. Moreover, as shown in FIG. 2C, the position where the assembly end TA1 and the assembly end TA2 are assembled together is the assembly end TA as shown in FIG. 1.

The post columns 110 can be divided into a first type of post column 110A in FIG. 2A and a second type of post column 110B in FIG. 2B. A foot column 170 is mounted at the bottom 112D of the first type of post column 110A, in order to increase the stability of the overall concave square tube storage shelf 100 through the foot column 170 as shown in FIG. 1. The second type of post column 110B is provided with a connector 160, and the connector 160 of the second type of post column 110B is assembled on the first type of post column 110A to increase the height of the overall post column 110 as shown in FIG. 1.

Specifically, the first type of post column 110A and the second type of post column 110B in the post columns 110 respectively include a concave square tube 112 and a plurality of convex-type fastened components 116. The convex-type fastened components 116 are assembled on the concave plate KA at intervals, and the intervals may be the same or different. Taking FIG. 2A and FIG. 2B as an example, every two of these convex-type fastened components 116 constitute a component LT, and there is a distance between these components LT.

The concave square tube 112 is a square tube structure having concave composed of a first plate 112A, a second plate 112B, a third plate 112C, and a concave plate KA. The square tube is changed into a concave square tube 112 by the present disclosure to increase the structural strength of the post column 110.

The first plate 112A and the second plate 112B are parallel to each other. Both sides of the third plate 112C are connected to the first plate 112A and the second plate 112B respectively to form a three-sided structure. Both sides of the concave plate KA are connected respectively to the first plate 112A and the second plate 112B, so that the first plate 112A, the second plate 112B, the third plate 112C, and the concave plate KA are connected to form a three-dimensional concave structure. The first plate 112A and the second plate 112B are opposite sides, the concave plate KA and the third plate 112C are opposite sides. In addition, there is a hollow portion LD between the first plate 112A, the second plate 112B, the third plate 112C, and the concave plate KA. That is, the concave square tube 112 has a hollow portion LD within it as a hollow tube and is fitted with a concave plate KA to enhance the structural strength of the overall concave square tube 112 in order to withstand external pressures and loads.

The connector 160 can be assembled into the hollow portion LD inside the concave square tube 112. The hollow portion LD is the space inside the concave square tube 112. The structural configuration of the connector 160 can be adjusted based on the structural configuration of the concave square tube 112. For example, the connector 160 is a concave component 162. The two ends of the concave component 162 are provided with a convex protrusions 162A, so that the concave component 162 has a concave shape and can match the shape of the concave plate KA.

The concave plate KA includes a concave portion KA1, a first plate portion KA2, and a second plate portion KA3. Both sides of the concave portion KA1 are connected to the first plate portion KA2 and the second plate portion KA3, the first plate portion KA2 is connected to the first plate 112A, the second plate portion KA3 is connected to the second plate 112B, and the concave portion KA1 can be a recessed part of the concave plate KA. The hollow portion LD includes two hollow concave portions LD1 and LD2 and a hollow body portion LD3 according to the configuration of the concave plate KA. The hollow body portion LD3 connects with the two hollow concave portions LD1 and LD2. When the connector 160 is inserted into the hollow portion LD, the concave component 162 corresponds to the backside surface of the concave plate KA, the concave component 162 is located in the hollow body portion LD3, and the protrusions 162A on both sides of the concave component 162 are located at the hollow concave portions LD1 and LD2, so that the second type of post column 110B and the first type of post column 110A are assembled together.

Figure 4C:
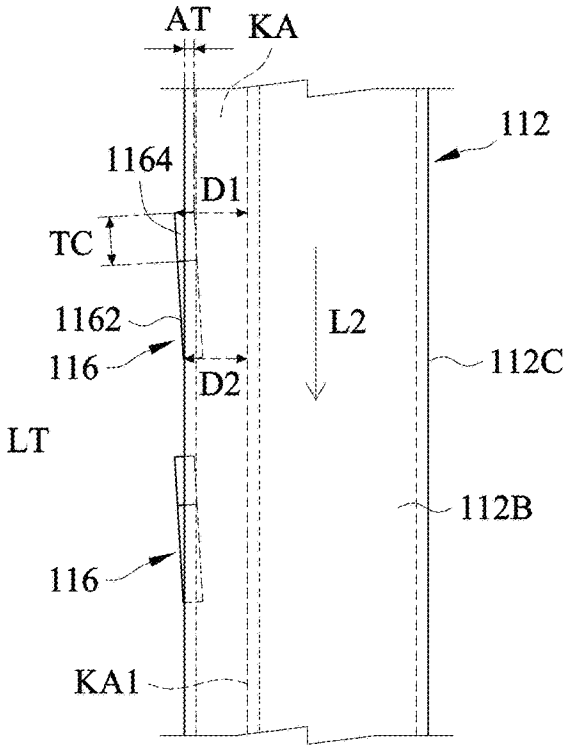
FIG. 4C is a side view of a concave square tube and a convex-type fastened component according to the present disclosure.
Figure 4B:
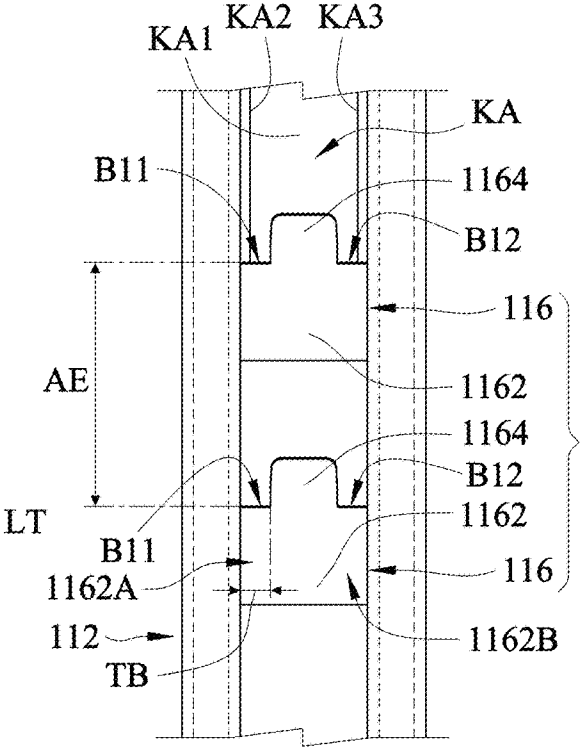
FIG. 4B is a schematic view of the concave square tube and the convex-type fastened component according to the present disclosure.
Figure 4A:
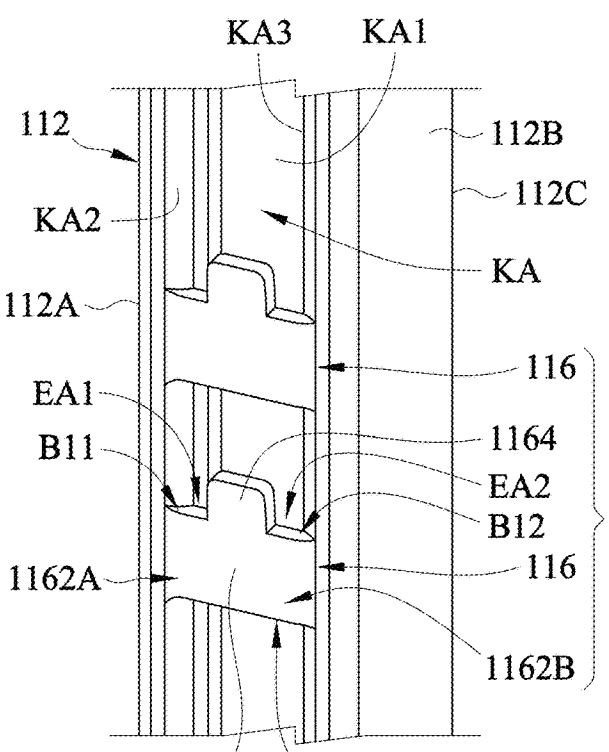
FIG. 4A is a three-dimensional diagram of a concave square tube and a convex-type fastened component according to the present disclosure.

FIG. 4A is a three-dimensional diagram of a concave square tube and a convex-type fastened component according to the present disclosure. FIG. 4B is a schematic view of the concave square tube and the convex-type fastened component according to the present disclosure. FIG. 4C is a side view of a concave square tube and a convex-type fastened component according to the present disclosure. Please refer to FIGS. 2A to 4C. These convex-type fastened component 116 are respectively provided at different positions in the concave plate KA of the concave square tube 112. In one embodiment, these convex-type fastened component 116 are secured to the concave plate KA by welding.

In this embodiment, every two convex-type fastened components 116 are set to be a group, and there is a fasteners component arrangement distance AE between the two convex-type fastened components 116. In addition, every two convex-type fastened components 116 form a component LT, and there is a distance between these components LT. The convex-type fastened component 116 is a convex structure and can be an iron piece. The convex-type fastened component 116 includes a fastener body 1162, a convex block 1164, and two assembly notches EA1 and EA2. The convex block 1164 is connected to the fastener body 1162, and the convex block 1164 has the assembly notches EA1 and EA2 on both sides.

A first block 1162A and a second block 1162B are provided on both sides of the fastener body 1162 respectively. The first block 1162A is connected to the first plate portion KA2 in the concave plate KA, and the second block 1162B is connected to the second plate portion KA3 in the concave plate KA. In other words, both sides of the fastener body 1162 are respectively connected to the first plate portion KA2 and the second plate portion KA3.

The first block 1162A of the present disclosure has a length TB, and an assembly notch EA1 is formed between the top B11 of the first block 1162A and the convex block 1164. Similarly, the length of the second block 1162B can be the same as the length TB of the first block 1162A. An assembly notch EA2 is formed between the top B12 of the second block 1162B and the convex block 1164. That is, the assembly notches EA1 and EA2 are the notches between the convex block 1164 and the fastener body 1162.

As shown in FIG. 4C, the convex block 1164 has a protrusion length TC. The convex-type fastened component 116 is separated from the concave portion KA1 by a distance, and the convex-type fastened component 116 is tilted outward relative to the concave square tube 112 by an inclination angle AT. In other words, the first distance D1 from the top end of the convex block 1164 to the concave portion KA1 is greater than the second distance D2 from the bottom end of the fastener body 1162 to the concave portion KA1.

In one embodiment, along a first assembly direction L2, the inclination angle AT of the convex-type fastened component 116 provides an inclined opening, allowing the user to easily insert a fastener (such as the first fastener CA1 in FIG. 7B or the second fastener CA2 in FIG. 8B) for assembling. The first assembly direction L2 is, for example, opposite to the stacking direction L1 in FIG. 1. The first assembly direction L2 is parallel to the lifting direction LA.

Figure 5:
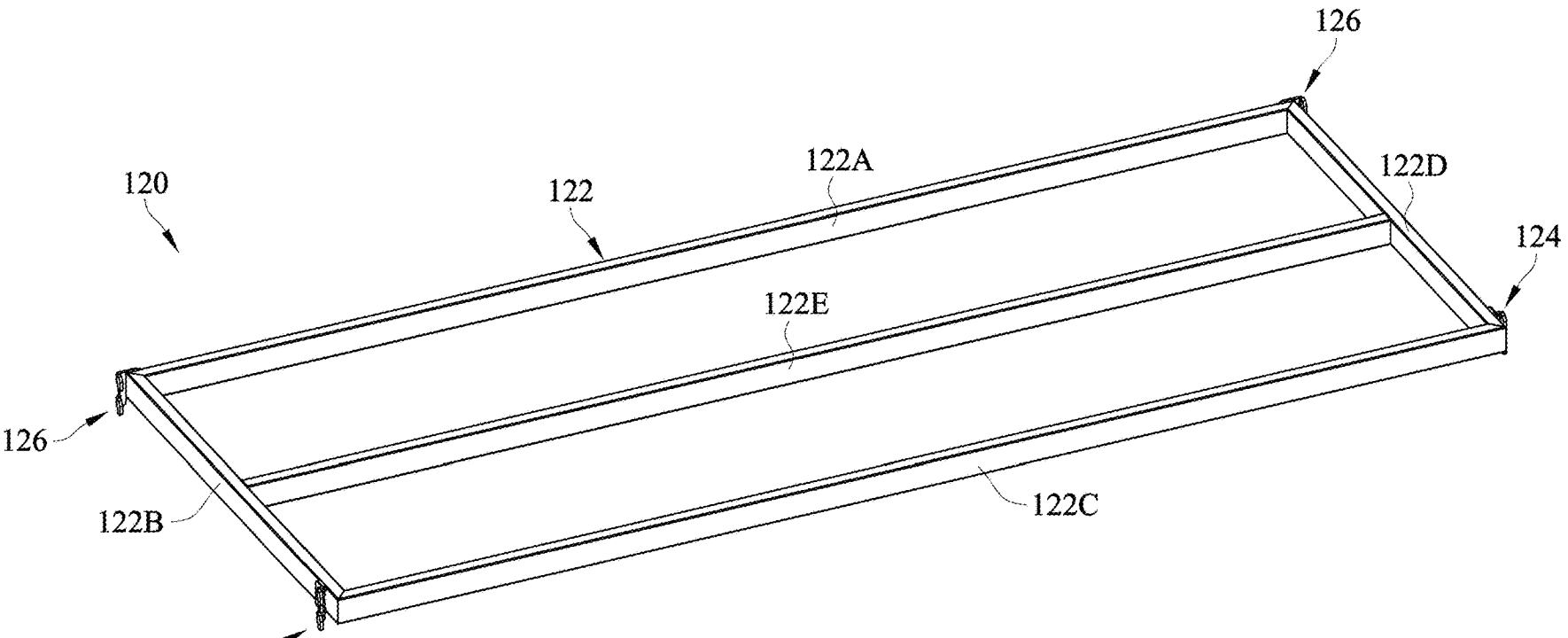
FIG. 5 is a three-dimensional schematic of a storage layer according to the present disclosure.
Figure 6:
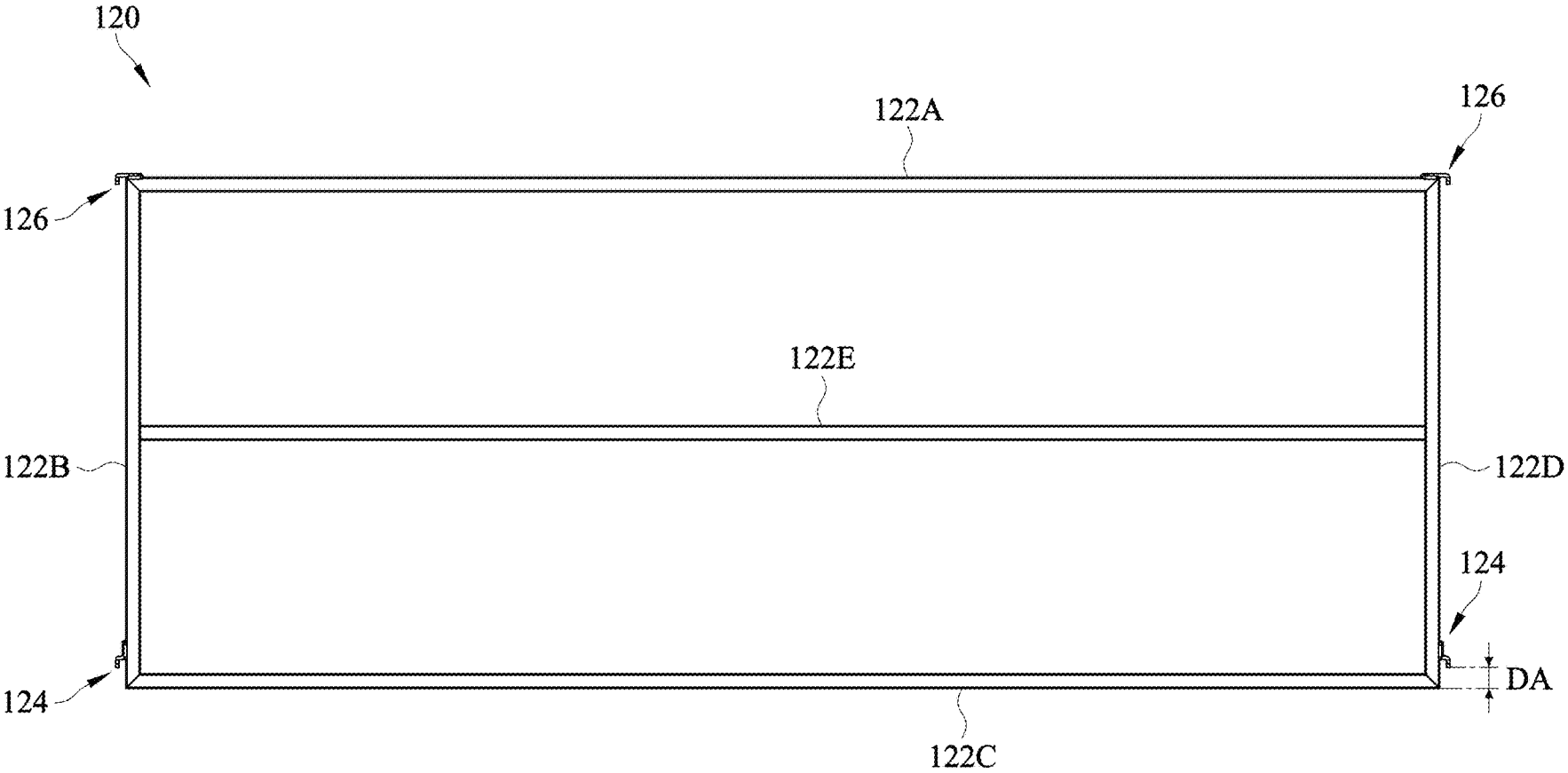
FIG. 6 is a schematic plan view of a storage layer according to the present disclosure.

FIG. 5 is a three-dimensional schematic of a storage layer according to the present disclosure. FIG. 6 is a schematic plan view of a storage layer according to the present disclosure. Please refer to FIGS. 5 and 6. The storage layer 120 of the present disclosure includes a shelf 122, two first assembly components 124, and two second assembly components 126. The shelf 122 is a long-shaped frame body, and it includes a first cross member 122A, a second cross member 122B, a third cross member 122C, a fourth cross member 122D and a support member 122E. The extending direction of the first cross member 122A is parallel to the extending direction of the third cross member 122C. The first cross member 122A and the third cross member 122C are separated by a distance. The extending direction of the second cross member 122B is parallel to the extending direction of the fourth cross member 122D. The second cross member 122B and the fourth cross member 122D are separated by a distance. Two ends of the first cross member 122A are connected to the second cross member 122B and the fourth cross member 122D, and the two ends of the third cross member 122C are connected to the second cross member 122B and the fourth cross member 122D, to form the long-shaped frame body as shown in FIG. 5 or FIG. 6. In addition, the support member 122E is provided between the second cross member 122B and the fourth cross member 122D, so that the extending directions of the first cross member 122A, the third cross member 122C and the support members 122E are parallel.

In this embodiment, the two first assembly components 124 and the two second assembly components 126 are respectively disposed at positions corresponding to the cross members of the shelf 122. For example, the second cross member 122B and the fourth cross member 122D are provided with a first assembly component 124, and the opposite ends of the first cross member 122A are respectively provided with a second assembly component 126.

Specifically, there is a setting distance DA between the first assembly component 124 and one end of the fourth cross member 122D. Similarly, the first assembly component 124 is provided with the second cross member 122B in the same location as the first assembly component 124 is provided with the fourth cross member 122D. One side of the second assembly component 126 is disposed on the first cross member 122A, and a part of the second assembly component 126 (such as the second fastener in FIG. 8B) spans and is located outside the second cross member 122B and the fourth cross member 122D.

Figure 7B:
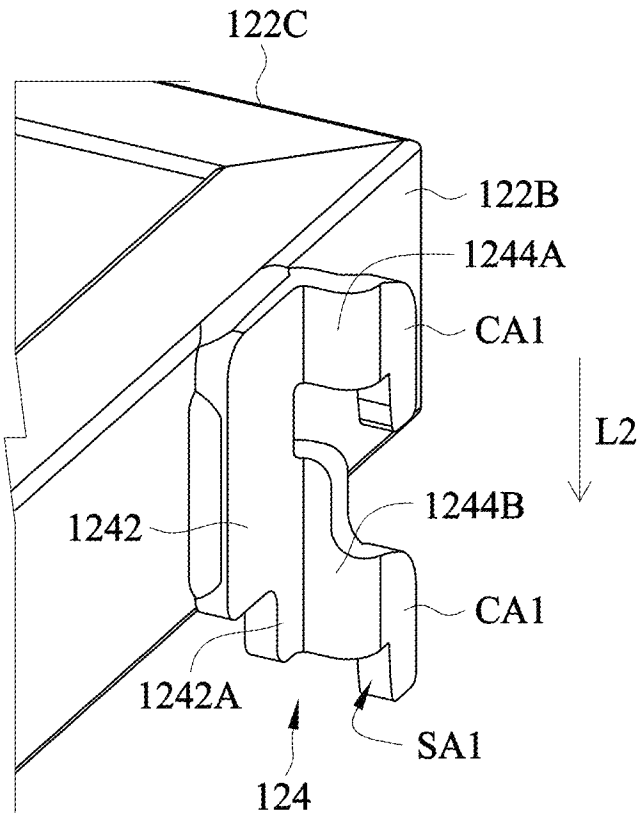
FIG. 7B is a three-dimensional partial schematic view of the first assembly component combined with the shelf according to the present disclosure.
Figure 7A:
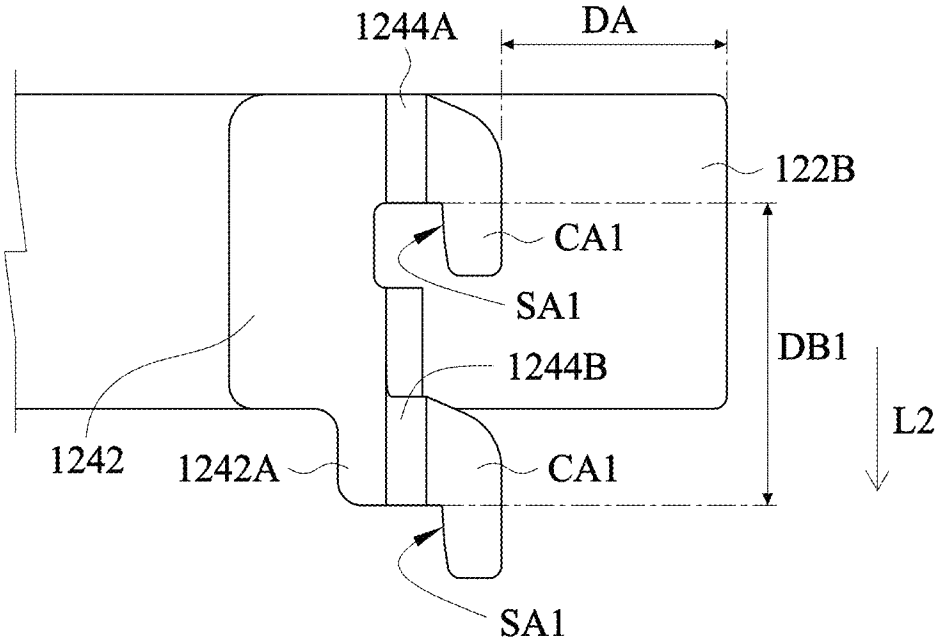
FIG. 7A is a side partial schematic view of the first assembly component combined with the shelf according to the present disclosure.

FIG. 7A is a side partial schematic view of the first assembly component combined with the shelf according to the present disclosure. FIG. 7B is a three-dimensional partial schematic view of the first assembly component combined with the shelf according to the present disclosure. Please refer to FIGS. 7A and 7B. Taking the first assembly component 124 provided on the second cross member 122B in FIG. 5 as an example, the structure and the relative relationship of the first assembly component 124 being disposed on the fourth cross member 122D is the same as those of the first assembly component 124 being disposed on the second cross member 122B.

The first assembly component 124 of the present disclosure includes a first fixture 1242, two first turning parts 1244A, 1244B, and two first fasteners CA1. The first fixture 1242 is a plate body, and the first fixture 1242 is fixed on the surface of the second cross member 122B in the shelf 122 to dispose the first assembly component 124 on the second cross member 122B. In the same way, the first fixture can be fixed on the outer surface of the fourth cross member in the shelf to dispose the first assembly component 124 on the fourth cross member 122D.

The two first turning parts 1244A and 1244B are respectively connected between the two first fasteners CA1 and the first fixture 1242. The two first turning parts 1244A and 1244B are a plate body bending from one side of the first fixture 1242, and the two first fasteners CA1 are respectively connected to the corresponding first turning parts 1244A and 1244B, so that there is a distance between the two first fasteners CA1 and the surface of the second cross member 122B. That is, the two first fasteners CA1 are not in contact with or combined with the surface of the second cross member 122B. The inner side surface of the first fastener CA1 is an inclined plane SA1. In other words, the fastener of the present disclosure has an inclined plane.

In addition, the setting distance DA as shown in FIG. 5, in one embodiment, can be the distance between the first fastener CA1 and one end of the second cross member 122B. Accordingly, the two first fasteners CA1 the first assembly component 124 are not flush with one end of the second cross member 122B but have a setting distance DA.

In a further embodiment, there is a fastener distance DB1 between the two first fasteners CA1, and the size of the fastener distance DB1 can be adjusted based on the actual situation. The first fixture 1242 has a first protruding block 1242A. The first protruding block 1242A is a protruding structure extending parallel to one side of the first fixture 1242.

Figure 8B:
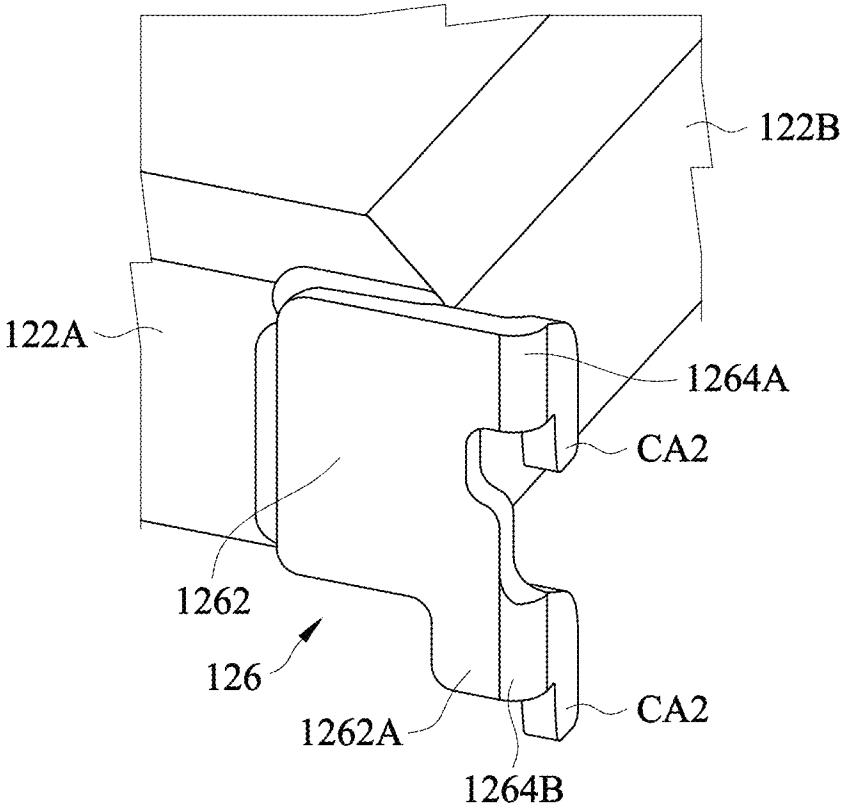
FIG. 8B is a three-dimensional partial schematic view of the second assembly component combined with the shelf according to the present disclosure.
Figure 8A:
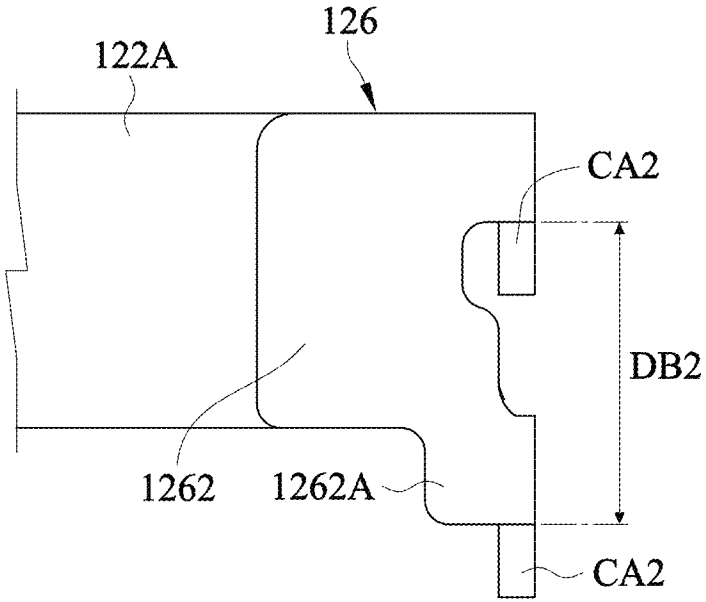
FIG. 8A is a partial schematic side view of the second assembly component combined with the shelf according to the present disclosure.

FIG. 8A is a partial schematic side view of the second assembly component combined with the shelf according to the present disclosure. FIG. 8B is a three-dimensional partial schematic view of the second assembly component combined with the shelf according to the present disclosure. Please refer to FIGS. 8A and 8B. The second assembly component 126 of the present disclosure includes a second fixture 1262, two second turning parts 1264A, 1264B, and two second fasteners CA2. The second fixture 1262 is a plate body. The second fixture 1262 is fixed on the surface of the first cross member 122A in the shelf 122 to dispose the second assembly component 126 on the first cross member 122A.

The two second turning parts 1264A and 1264B are respectively connected between the two second fasteners CA2 and the second fixture 1262. The two second turning parts 1264A and 1264B are a plate body bent from one side of the second fixture 1262, and one side of the second fixture 1262 protrudes from one end of the first cross member 122A and is adjacent to the second cross member 122B (or the fourth cross member 122D as shown in FIG. 5). In addition, the two second fasteners CA2 are respectively connected to the corresponding second turning parts 1264A and 1264B, so that there is a distance between the two second fasteners CA2 and the surface of the second cross member 122B. That is, the two second fasteners CA2 are not in contact with or combined with the surface of the second cross member 122B. Based on the foregoing, through the second turning parts 1264A and 1264B, the two second fasteners CA2 of the second assembly component 126 are located outside the second cross member 122B (or the fourth cross member 122D as shown in FIG. 5).

Furthermore, a fastener distance DB2 is provided between the two second fasteners CA2, and the size of the fastener distance DB2 can be adjusted based on the actual situation. The second fixture 1262 has a second protruding block 1262A. The second protruding block 1262A is a protruding structure extending parallel to one side of the second fixture 1262. The second protruding block 1262A is connected to the second turning part 1264B.

Based on the foregoing, the fasteners of the storage layers 120 of the present disclosure are provided on the shelves 122, such as the configurations of the first fastener CA1 and the second fastener CA2. The number and arranging configuration of the fasteners can be adjusted according to the actual situation. Taking FIG. 7B as an example, the first assembly component 124 can be a Z-shaped buckle structure, and the first fastener CA1 is a fastener of the Z-shaped buckle structure. Taking FIG. 8B as an example, the second assembly component 126 is an L-shaped buckle structure, and the second fastener CA2 is a fastener of the L-shaped buckle structure.

Figure 9:
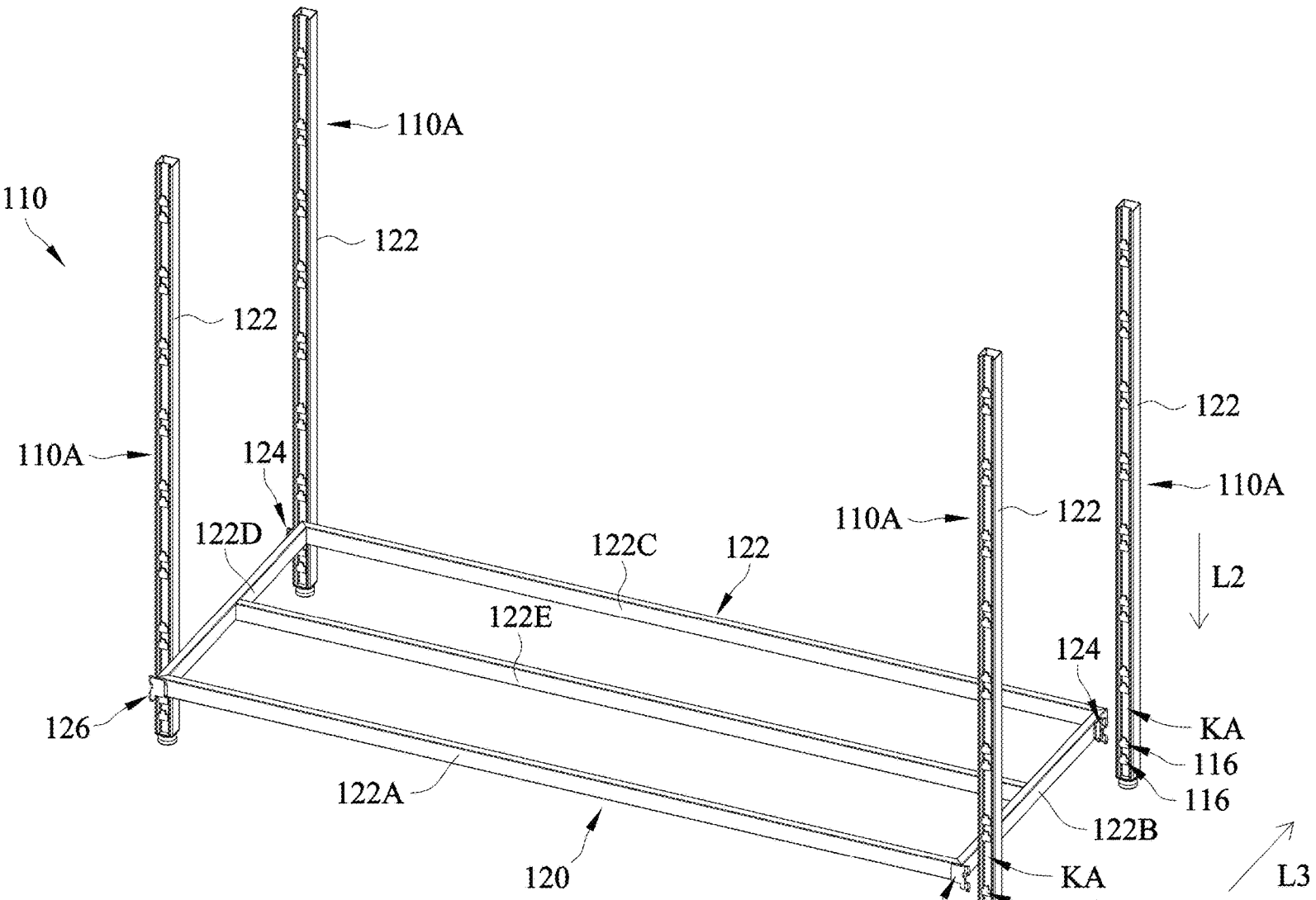
FIG. 9 is a three-dimensional diagram of a process of installing the storage layer to the post column according to the present disclosure.
Figure 10B:
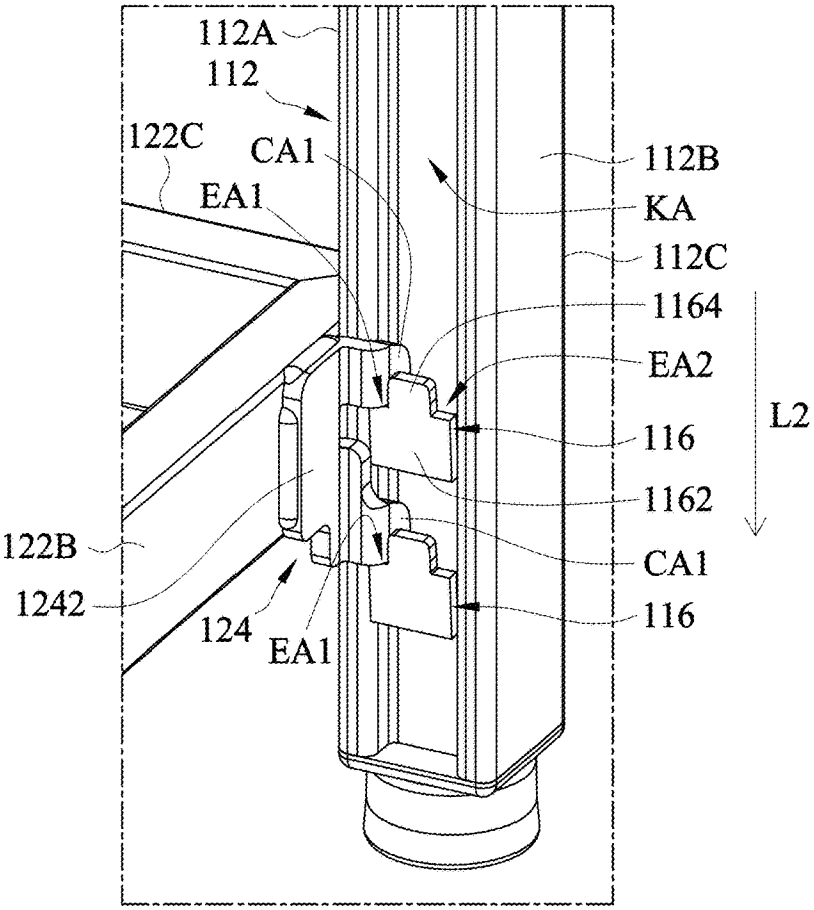
FIG. 10B is a three-dimensional diagram of the first assembly component fastened to the convex-type fastened component according to the present disclosure.
Figure 10A:
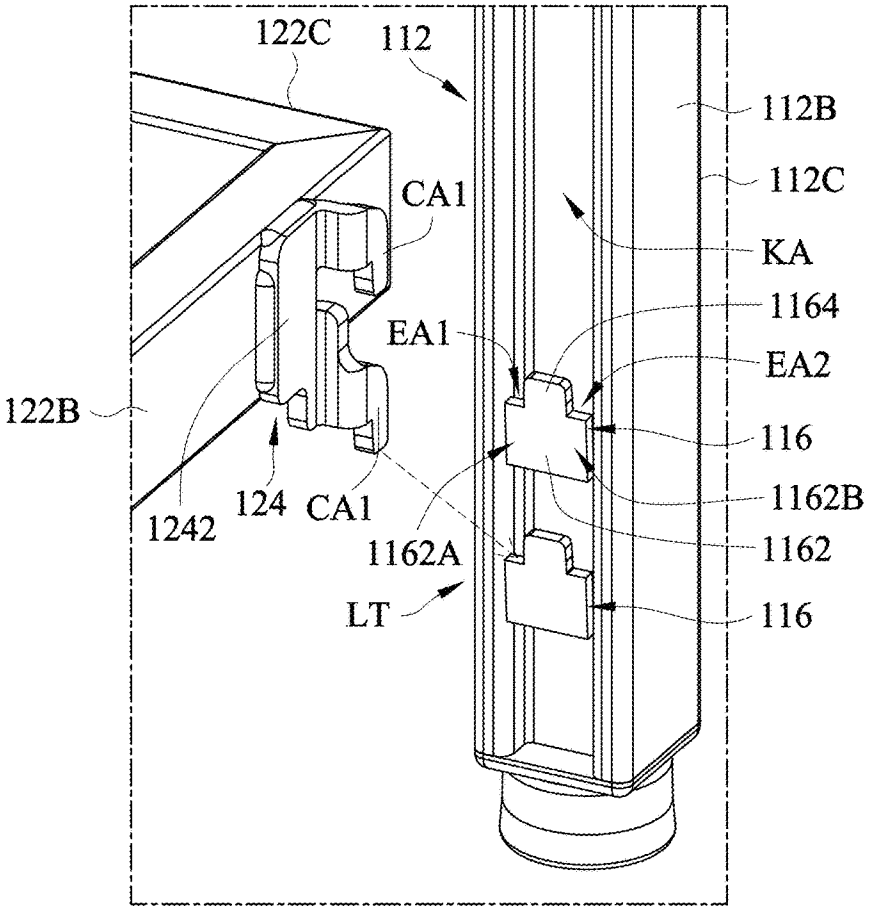
FIG. 10A is a three-dimensional diagram of a process of assembling the first assembly component to the convex-type fastened component according to the present disclosure.
Figure 11B:
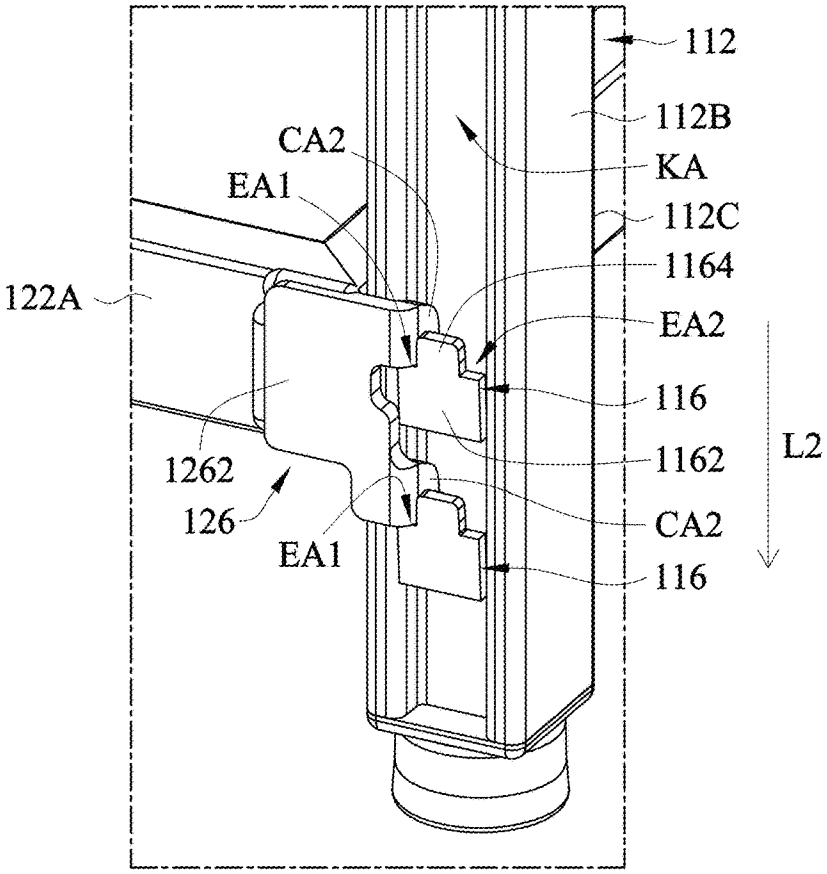
FIG. 11B is a three-dimensional diagram of the second assembly component fastened to the convex-type fastened component according to the present disclosure.
Figure 11A:
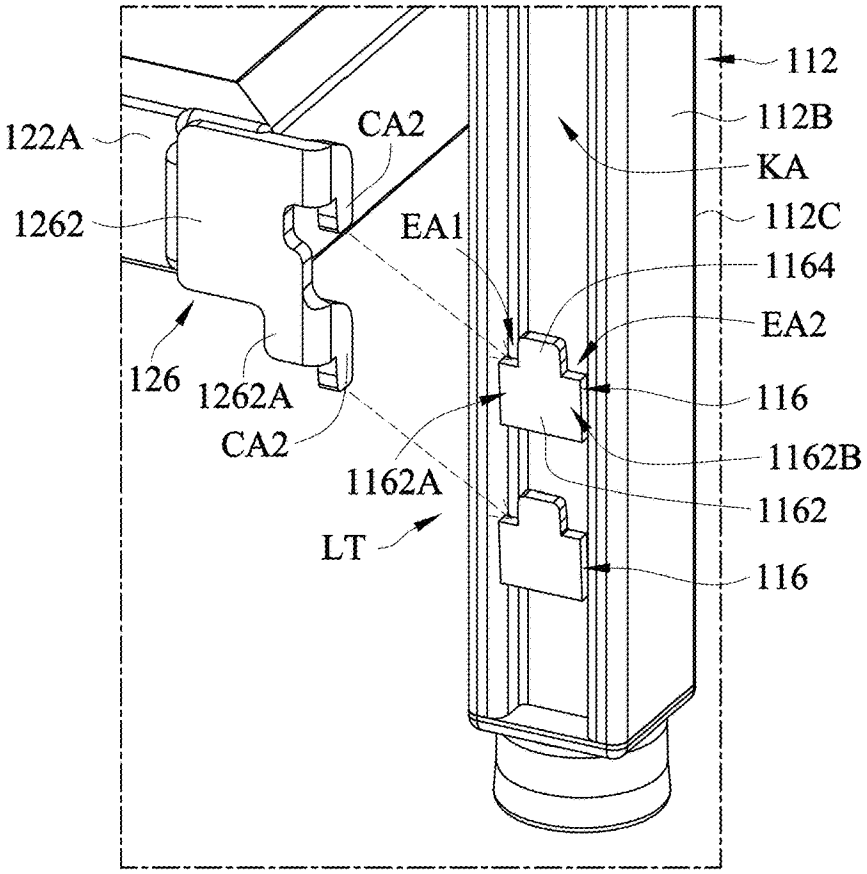
FIG. 11A is a three-dimensional diagram of a process of assembling the second assembly component to the convex-type fastened component according to the present disclosure.

FIG. 9 is a three-dimensional diagram of a process of installing the storage layer to the post column according to the present disclosure. FIG. 10A is a three-dimensional diagram of a process of assembling the first assembly component to the convex-type fastened component according to the present disclosure. FIG. 10B is a three-dimensional diagram of the first assembly component fastened to the convex-type fastened component according to the present disclosure. FIG. 11A is a three-dimensional diagram of a process of assembling the second assembly component to the convex-type fastened component according to the present disclosure. FIG. 11B is a three-dimensional diagram of the second assembly component fastened to the convex-type fastened component according to the present disclosure.

Please refer to FIG. 9 first. In this embodiment, during the process of assembling a storage layer 120 to the four post columns 110, the storage layer 120 is first moved toward a second assembly direction L3. The second assembly direction L3 is a horizontal movement. Alternatively, it faces and moves in the direction of the concave plate KA of the concave square tube 112.

Afterwards, as shown in FIG. 10A, the two first fasteners CA1 in the first assembly component 124 move toward the direction of the concave plate KA of the concave square tube 112. Accordingly, the two first fasteners CA1 gradually approach the position of the two convex-type fastened components 116, until the two first fasteners CA1 are located within the concave plate KA. In addition, the two first fasteners CA1 are respectively located above the assembly notch EA1 on the left side of the convex block 1164 of the corresponding convex-type fastened component 116.

Afterwards, the storage layer 120 continues to move along the first assembly direction L2. That is, the two first fasteners CA1 move downward to the assembly notch EA1 until the two first fasteners CA1 are fastened to the assembly notch EA1 on the left side of the convex block 1164 of the convex-type fastened component 116, as shown in FIG. 10B, in order to fix the first assembly component 124 in the storage layer 120 to the concave square tube 112 in the post column 110.

In addition, as shown in FIG. 4C of the present disclosure, along a first assembly direction L2, the inclination angle AT of the convex-type fastened component 116 can provide an inclined opening. Therefore, when the two first fasteners CA1 move downwards to the assembly notch EA1, the first fastener CA1 can be utilized to be inserted into and fastened on the assembly notch EA1 by the convex block 1164.

Furthermore, in correspondence with the aforementioned inclination angle AT, the first fastener CA1 itself has an inclination (such as the inclination plane SA1 shown in FIG. 7A), and the inclination structure of the first fastener CA1 is snapped into the convex-type fastened component 116 with the inclination angle AT for matching and fastening to increase stability.

In addition, the setting distance DA as shown in FIG. 7 allows reserving a certain distance for the first assembly component 124 in FIG. 10A, and the portion of the second cross member 122B can be close to or fit against a wall surface (such as the first plate 112A) of the concave square tube 112.

In the meanwhile, as shown in FIG. 11A, the two second fasteners CA2 in the second assembly component 126 move toward the concave plate KA of the concave square tube 112. Accordingly, the two second fasteners CA2 gradually approach the position of the two convex-type fastened components 116, until the two second fasteners CA2 are located within the concave plate KA. In addition, the two second fasteners CA2 are respectively located above the assembly notch EA1 on the left side of the convex block 1164 of the corresponding convex-type fastened component 116.

Afterwards, the storage layer 120 continues to move along the first assembly direction L2. That is, the two second fasteners CA2 move downward to the assembly notch EA1 until the two second fasteners CA2 are fastened to the assembly notch EA1 on the left side of the convex block 1164 of the convex-type fastened component 116, as shown in FIG. 11B, in order to fix the second assembly component 126 in the storage layer 120 to the concave square tube 112 in the post column 110.

In addition, as shown in FIG. 4C of the present disclosure, along a first assembly direction L2, the inclination angle AT of the convex-type fastened component 116 can provide an inclined opening. Therefore, when the two second fasteners CA2 move downwards to the assembly notch EA1, the second fastener CA2 can be utilized to be inserted into and fastened on the assembly notch EA1 by the convex block 1164.

Furthermore, in correspondence with the aforementioned inclination angle AT, the second fastener CA2 itself has an inclination, and the inclination structure of the second fastener CA2 is snapped into the convex-type fastened component 116 with the inclination angle AT for matching and fastening to increase stability.

As such, by fastening the fastener of the storage layer 120 of the present disclosure (such as the first fastener CA1 and the second fastener CA2) to the assembly notch EA1 of the convex-type fastened component 116, the storage layers 120 can be fixed between these four post columns 110, as shown in FIG. 1. Afterwards, the laminate 130 includes a laminate body 132 and four notch portions 134. The notch portions 134 are notches at the four corners of the laminate body 132. When the laminate 130 is placed on the storage layer 120, the four notches 134 will engage with the post columns 110, so that the laminates 130 are fixed between these post columns 110.

Afterwards, the storage layers 120 and the laminates 130 are sequentially arranged between the post columns 110 along the stacking direction L1, in order to form the concave square tube storage shelf 100 as shown in FIG. 1.

In addition, since these convex-type fastened components 116 are provided at different positions within the concave plate KA in the concave square tube 112, the storage layer 120 is thus moved to release the fastening relationship of the fasteners of the storage layer 120 (such as the first fastener CA1 and the second fastener CA2) and the assembly notch EA1 of the convex-type fastened component 116. In addition, the fasteners of the storage layer 120 (such as the first fastener CA1 and the second fastener CA2) can be fastened to the assembly notch EA1 of the convex-type fastened component 116 at different positions based on actual situations to adjust and lift the position of the storage layer 120.

Figure 12:
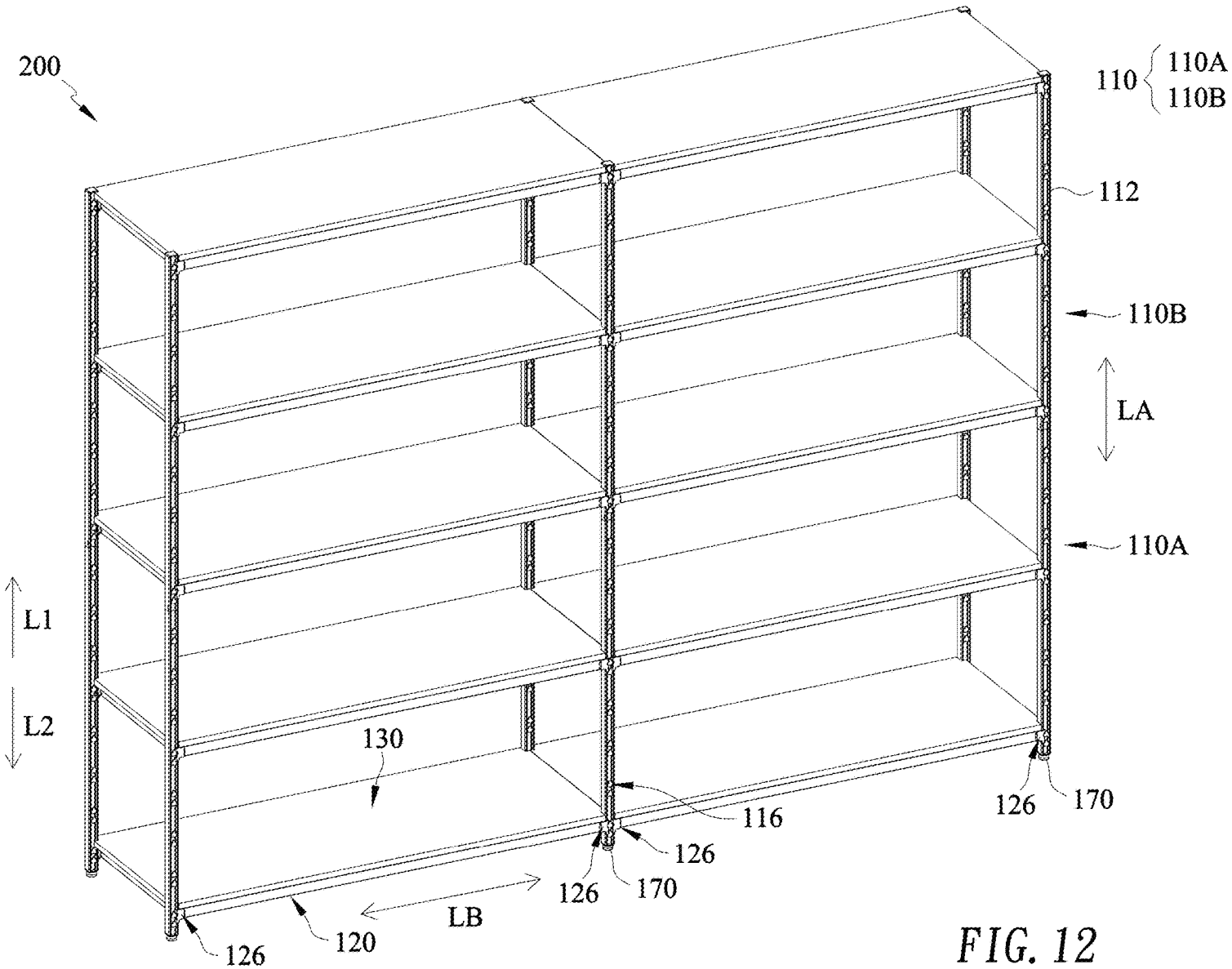
FIG. 12 is a three-dimensional diagram of another embodiment of a concave square tube storage shelf according to the present disclosure.
Figure 13:
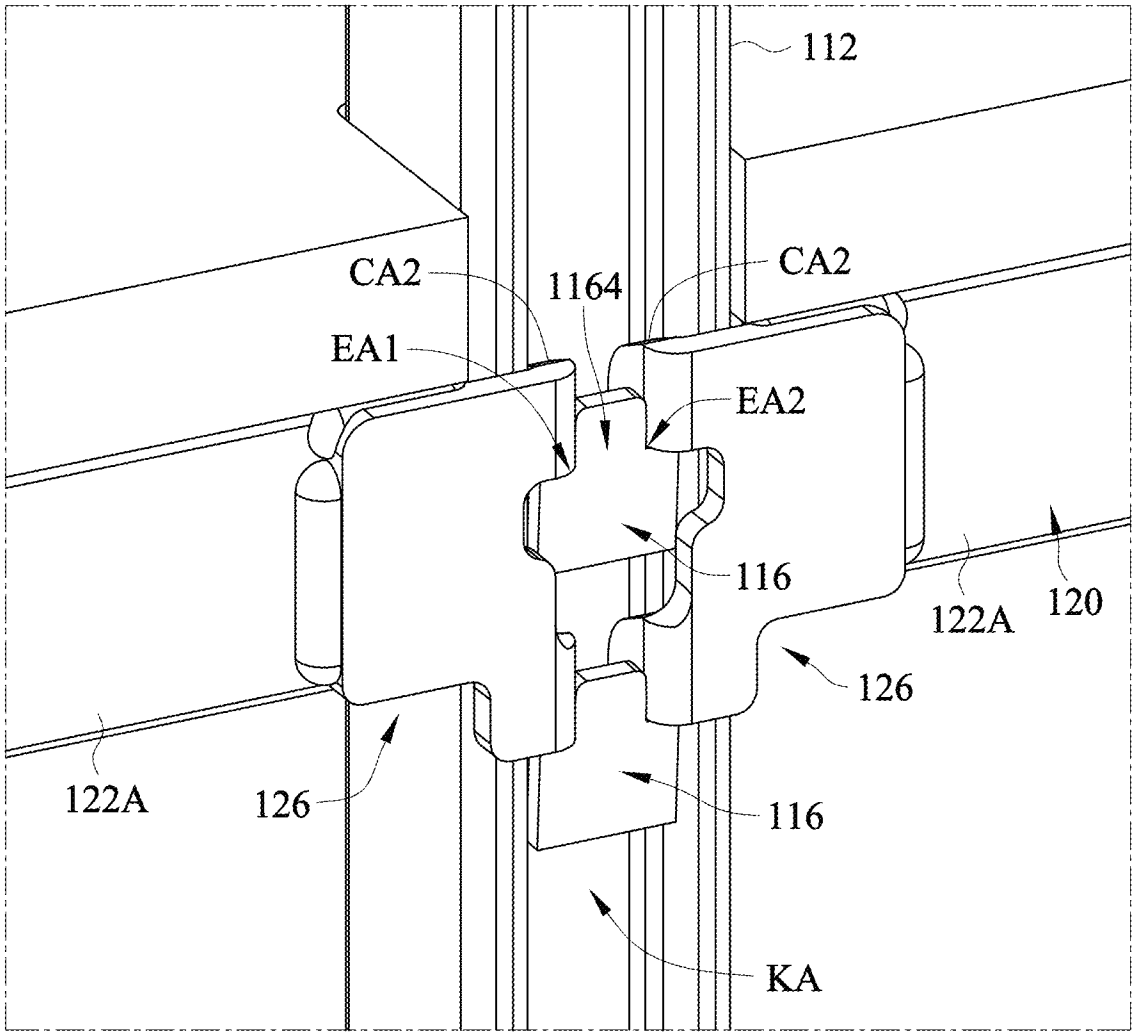
FIG. 13 is a three-dimensional diagram of an embodiment of fastening the convex-type fastened components in the post column according to the present disclosure.

FIG. 12 is a three-dimensional diagram of another embodiment of a concave square tube storage shelf according to the present disclosure. FIG. 13 is a three-dimensional diagram of an embodiment of fastening the convex-type fastened components in the post column according to the present disclosure. Please refer to FIGS. 1 and 12 first. The difference between the concave square tube storage shelf 200 in FIG. 12 and the concave square tube storage shelf 100 in FIG. 1 is that along a transverse direction LB, the concave square tube storage shelf 200 has a two-row structure, and the transverse direction LB is perpendicular to the lifting direction LA.

As shown in FIG. 13 or FIG. 3, an assembly notch EA1, EA2 is provided on both sides of the convex block 1164 of the convex-type fastened component 116 respectively, so that the left and right sides of the same concave square tube 112 can be assembled with one storage layer 120 respectively. That is, the adjacent storage layers 120 can share a concave square tube 112 for aesthetic appeal and cost savings.

Based on the foregoing, the concave square tube storage shelf disclosed in the present disclosure has a simple and relatively stable assembly structure, to improve the overall convenience of use.

Furthermore, the present disclosure changes the square tube into a concave square tube to increase the structural strength.

In addition, along a first assembly direction, the inclination angle of the convex-type fastened component can provide an inclined opening, which facilitates the fastener to be inserted into and fastened on the assembly notch by the convex block.

Furthermore, in correspondence with the aforementioned inclination angle, the inclination structure of the fastener is snapped into the convex-type fastened component with the inclination angle for matching and fastening to increase stability.

In addition, an assembly notch is provided on both sides of the convex-type fastened component respectively according to one embodiment, so that the left and right sides of the same concave square tube can be assembled with a storage layer respectively. That is, the adjacent storage layers can share a concave square tube for aesthetic appeal and cost savings.

Although the disclosure has been disclosed in the form of embodiments, it is not intended to limit the present disclosure. Anyone with general knowledge in the field of technology may make some changes and modifications without departing from the spirit and scope of the present disclosure, and therefore the scope of protection of the disclosure shall be subject to the scope of the patent application attached hereto.

What is claimed is:

1. A concave square tube storage shelf, comprising a plurality of post columns, each comprising:

a concave square tube, wherein the concave square tube comprises a first plate, a second plate, a third plate, and a concave plate, the first plate and the second plate are parallel and opposing to each other, the third plate is connected to both the first plate and the second plate, the concave plate is connected to both the first plate and the corresponding second plate; a plurality of convex-type fastened components, wherein the convex-type fastened components are respectively assembled on the concave plate at intervals, and each of the convex-type fastened components comprises a fastener body, a convex block, a first assembly notch, and a second assembly notch, the convex block is connected to the fastener body, the convex block is positioned between the first assembly notch and the second assembly notch, the fastener body has a first block and a second block, the first assembly notch is positioned between the first block and the convex block, and the second assembly notch is positioned between the second block and the convex block;

a plurality of storage layers, each comprising a shelf and a plurality of fasteners, wherein each fastener is engaged to one of the first assembly notches or one of the second assembly notches for securing the storage layers between the post columns; and a plurality of laminates, each disposed on one of the storage layers.

2. The concave square tube storage shelf according to claim 1, wherein each of the concave plates comprises a concave portion, a first plate portion connecting to the first plate, and a second plate portion connecting to the second plate, the concave portion is connected to both the first plate portion and the second plate portion; and wherein the first block of the fastener body is connected to the first plate portion and the second block of the fastener body is connected to the second plate portion.

3. The concave square tube storage shelf according to claim 2, wherein each of the convex-type fastened components is separated from the concave portion of the concave plate by a distance, and each of the convex-type fastened components is inclined outwardly at an inclination angle relative to the concave square tube.

4. The concave square tube storage shelf according to claim 1, wherein the fasteners have an inclination plane.

5. The concave square tube storage shelf according to claim 1, wherein the fasteners are two first fasteners and two second fasteners.

6. The concave square tube storage shelf according to claim 5, wherein each of the storage layers comprises two first assembly components and two second assembly components, each of the first assembly components is a Z-shaped buckle structure, the first fasteners are fasteners of a Z-shaped fastener structure, each of the second assembly components is an L-shaped buckle structure, and each of the second fasteners is a fastener of the L-shaped buckle structure.

7. A concave square tube storage shelf, comprising a plurality of post columns, each comprising:

a concave square tube, wherein the concave square tube comprises a first plate, a second plate, a third plate, and a concave plate, the first plate and the second plate are parallel and opposing to each other, the third plate is connected to both the first plate and the second plate, the concave plate is connected to both the first plate and the corresponding second plate; a plurality of convex-type fastened components, wherein the convex-type fastened components are respectively assembled on the concave plate at intervals, and each of the convex-type fastened components comprises a fastener body, a convex block, a first assembly notch, and a second assembly notch, the convex block is connected to the fastener body, the convex block is positioned between the first assembly notch and the second assembly notch;

a plurality of storage layers, each comprising a shelf and a plurality of fasteners, wherein each fastener is engaged to one of the first assembly notches or one of the second assembly notches for securing the storage layers between the post columns; and a plurality of laminates, each disposed on one of the storage layers;

wherein each of the concave plates comprises a concave portion, a first plate portion connecting to the first plate, and a second plate portion connecting to the second plate, the concave portion is connected to both the first plate portion and the second plate portion;

wherein a first block of the fastener body is connected to the first plate portion and a second block of the fastener body is connected to the second plate portion; and wherein each of the convex-type fastened components is separated from the concave portion of the concave plate by a distance, and each of the convex-type fastened components is inclined outwardly at an inclination angle relative to the concave square tube.

8. A concave square tube storage shelf, comprising a plurality of post columns, each comprising:

a concave square tube, wherein the concave square tube comprises a first plate, a second plate, a third plate, and a concave plate, the first plate and the second plate are parallel and opposing to each other, the third plate is connected to both the first plate and the second plate, the concave plate is connected to both the first plate and the corresponding second plate;

a plurality of convex-type fastened components, wherein the convex-type fastened components are respectively assembled on the concave plate at intervals, and each of the convex-type fastened components comprises a fastener body, a convex block, a first assembly notch, and a second assembly notch, the convex block is connected to the fastener body, the convex block is positioned between the first assembly notch and the second assembly notch;

a plurality of storage layers, each comprising a shelf, two Z-shaped fasteners, two L-shaped fasteners, two Z-shaped assembly buckle components, and two L-shaped assembly buckle components, wherein each of the two Z-shaped fasteners and the two L-shaped fasteners is engaged to one of the first assembly notches or one of the second assembly notches for securing the storage layers between the post columns; and a plurality of laminates, each disposed on one of the storage layers.

* * * * *